US007928666B2

(12) United States Patent
Biebel

(10) Patent No.: US 7,928,666 B2
(45) Date of Patent: Apr. 19, 2011

(54) LIGHTING SYSTEM

(75) Inventor: Ulrich Biebel, Rennertshofen (DE)

(73) Assignee: Osram Gesellschaft mit beschränkter Haftung, München (DE)

( * ) Notice: Subject to any disclaimer, the term of this patent is extended or adjusted under 35 U.S.C. 154(b) by 581 days.

(21) Appl. No.: 11/989,404

(22) PCT Filed: Jul. 26, 2006

(86) PCT No.: PCT/EP2006/007397

§ 371 (c)(1),
(2), (4) Date: Jan. 25, 2008

(87) PCT Pub. No.: WO2007/012481

PCT Pub. Date: Feb. 1, 2007

(65) Prior Publication Data

US 2009/0251895 A1 Oct. 8, 2009

(30) Foreign Application Priority Data

Jul. 28, 2005 (DE) ..... 10 2005 035 429

(51) Int. Cl.
*H05B 37/00* (2006.01)

(52) U.S. Cl. ..... 315/291; 315/307; 315/308; 362/253

(58) Field of Classification Search ..... 315/291, 315/307, 308, 312; 362/253
See application file for complete search history.

(56) References Cited

U.S. PATENT DOCUMENTS

| | | | | |
|---|---|---|---|---|
| 6,388,393 | B1 | 5/2002 | Illingworth | |
| 2005/0156496 | A1 | 7/2005 | Takashima | |
| 2006/0007682 | A1 * | 1/2006 | Reiff et al. | 362/253 |

FOREIGN PATENT DOCUMENTS

| | | | |
|---|---|---|---|
| JP | 2000-004051 | | 1/2000 |
| JP | 2000048970 | * | 2/2000 |
| JP | 2003-133087 | | 5/2003 |

* cited by examiner

*Primary Examiner* — David Hung Vu
(74) *Attorney, Agent, or Firm* — Cohen Pontani Lieberman & Pavane LLP

(57) ABSTRACT

A lighting system comprising an electric lamp (1), especially a fluorescent lamp, which is provided with a first (11) and at least one second lamp coil (12). The lighting system further comprises an electronic ballast (2) that is electrically connected to the lamp coils (11, 12) and at least two additional light sources (31*a* to 31*c*; 32*a* to 32*c*) which are interconnected in parallel. The parallel connection (3) of the two additional light sources (31*a* to 31*c*; 32*a* to 32*c*) are serially connected between the first (11) and the second lamp coil (12).

9 Claims, 1 Drawing Sheet

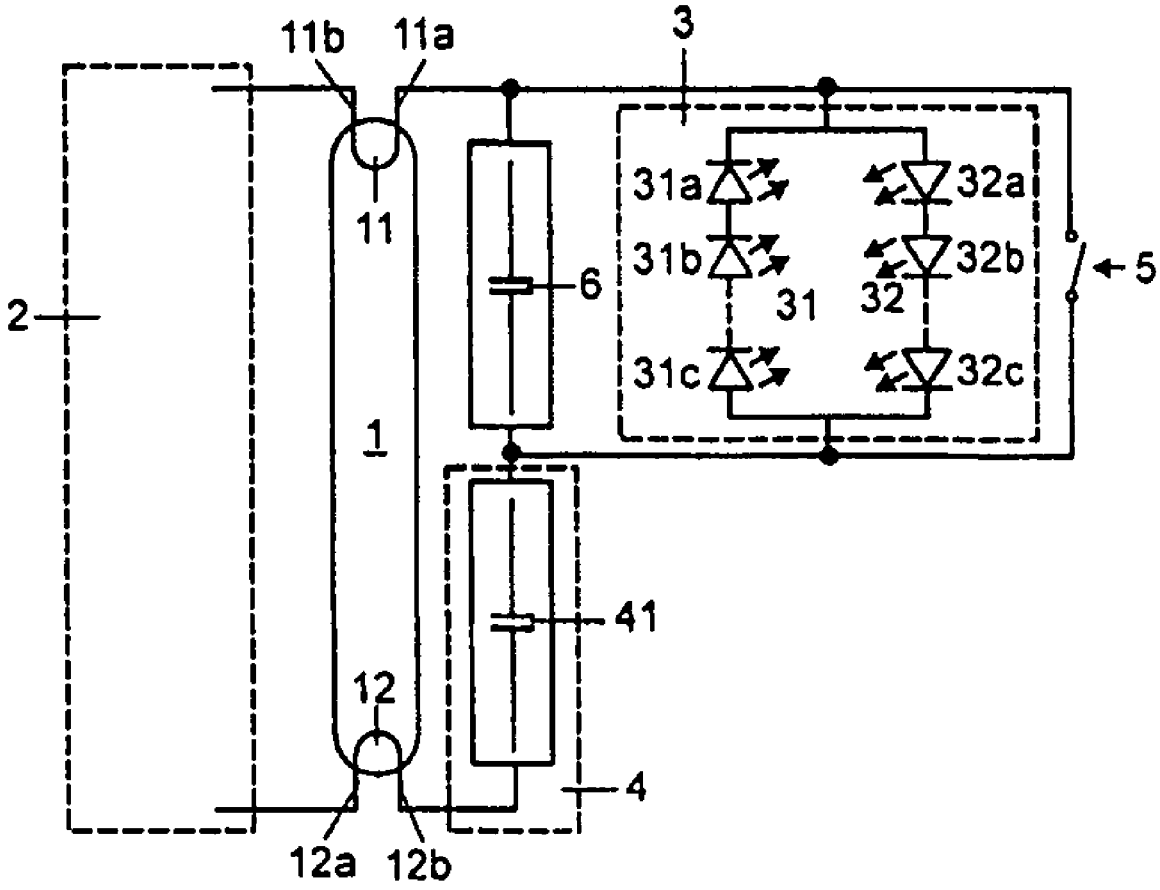
11b
11a
3
11
31a
32a
31b
32b
6
5
2
31
32
31c
32c
1
41
12
4
12a
12b

LIGHTING SYSTEM

RELATED APPLICATION

This is a U.S. national stage of application No. PCT/EP2006/007397, filed on 26 Jul. 2006.

This application claims the priority of German patent application no. 10 2005 035 429.7 filed Jul. 28, 2005, the content of which is hereby incorporated by reference.

FIELD OF THE INVENTION

The present invention relates to a lighting system with an electric lamp, in particular a fluorescent lamp.

BACKGROUND OF THE INVENTION

In known lighting systems with electric lamps, in particular fluorescent lamps, additional light sources are used in order to make it possible to shift the color locus in such electric lamps, in particular fluorescent lamps, during dimming. Such an arrangement of additional light sources is very involved, however, and the lighting system is relatively complex. A further disadvantage consists in the fact that the additional light sources have a separate power supply. This also results in a relatively involved and cost-intensive configuration of a lighting system.

SUMMARY OF THE INVENTION

One object of the present invention is to provide a lighting system with which the disadvantages from the prior art are overcome, i.e. in particular of being able to provide a lighting system with a relatively simple design and in the case of which the additional light sources can be supplied with energy with relatively little complexity.

This and other objects are attained in accordance with one aspect of the invention directed to a lighting system that comprises an electric lamp, which is in particular a fluorescent lamp. The electric lamp has at least one first and at least one second lamp filament and is electrically connected to an electronic ballast of the lighting system. Furthermore, the lighting system comprises at least two further light sources, which are connected in parallel with one another, the parallel circuit comprising the two further light sources being connected in series between the first and the second lamp filament of the electric lamp. Simple energy supply to the additional light sources, which are provided for shifting the color locus of the electric lamps, in particular the fluorescent lamps, during dimming, can be achieved with this lighting system. The lighting system can have a relatively simple design involving little complexity and can be realized in a relatively cost-effective manner.

Advantageously, the parallel circuit comprising the at least two further light sources are electrically connected to a first terminal of the first lamp filament and a first terminal of the second lamp filament. Preferably, the electronic ballast is electrically connected to a second terminal of the first lamp filament and to a second terminal of the second lamp filament. The additional light sources are therefore connected in series into the circuit, which is in parallel with the lamp, of the electronic ballast. This circuit in parallel with the lamp conducts only a relatively low current during undimmed operation. During dimmed operation, this current rises severely and therefore the light output of the additional light sources is considerably increased.

The two further light sources can be in the form of LEDs (light-emitting diodes) and are advantageously connected in phase opposition to one another into the respective signal paths of the parallel circuit. By virtue of the fact that the further light sources, in particular the LEDs, are arranged in phase opposition in the respective signal paths, it is possible for symmetrical currents to be produced. Without such an arrangement in phase opposition, a half-bridge rectifier would otherwise be formed. Provision may also be made for the additional light sources to be in the form of low-volt incandescent lamps.

Preferably, a lamp filament preheating means is connected in series with the parallel circuit comprising the two further light sources. Advantageously, this lamp filament preheating means is electrically connected to the first terminal of the second lamp filament. The lamp filament preheating means preferably comprises a reactance, in particular a capacitor. Provision may also be made for the lamp filament preheating means to be arranged in the electronic ballast.

Preferably, a switch is connected in parallel with the parallel circuit comprising the further light sources. Said switch can be in the form of, for example, a triac, a sidac, a transistor circuit or a relay. This switch arranged in parallel with the parallel circuit can be used to ensure that the additional light sources are bridged when igniting the electric lamp.

In a further advantageous embodiment, a reactance, in particular a capacitor, is connected in parallel with the parallel circuit comprising the further light sources. This makes it possible to ensure that the current through the additional light sources can be limited.

BRIEF DESCRIPTION OF THE DRAWINGS

An exemplary embodiment of the present invention will be explained in more detail below with reference to a schematic drawing. The single FIGURE, FIG. 1, shows a block circuit diagram of a lighting system according to the invention.

DETAILED DESCRIPTION OF THE DRAWINGS

The lighting system I according to the invention has an electric lamp, which in the exemplary embodiment is in the form of a fluorescent lamp 1. The fluorescent lamp 1 has a first lamp filament 11 and a second lamp filament 12. As can be seen from the illustration in FIG. 1, the first lamp filament 11 has a first electrical terminal 11*a* and a second electrical terminal 11*b*. Correspondingly, the second lamp filament 12 has a first electrical terminal 12*a* and a second electrical terminal 12*b*.

An electronic ballast 2 is electrically connected to the second electrical terminal 11*b* of the first lamp filament 11 and to the second electrical terminal 12*b* of the second lamp filament 12.

A parallel circuit 3 is connected in series with the first lamp filament 11 and the second lamp filament 12 in the circuit, which is in parallel with the lamp, of the electronic ballast 2. As can be seen in FIG. 1, the parallel circuit 3 is electrically connected to the first terminal 11*a* of the first lamp filament 11 and to the first terminal 12*b* of the second lamp filament 12. The parallel circuit 3 comprises additional light sources for shifting the color locus of the fluorescent lamp 1 during dimming, the additional light sources being in the form of LEDs 31*a* to 31*c* and 32*a* to 32*c*. As is shown in FIG. 1, the LEDs 31*a* to 31*c* are connected in a first signal path 31 of the parallel circuit 3, the LEDs 32*a* to 32*c* being connected into a second signal path 32 of the parallel circuit 3. The LEDs 31*a* to 31*c* connected in the first signal path 31 are in this case connected in phase opposition to the LEDs 32*a* to 32*c* of the signal path 32 into the parallel circuit 3. As has already been explained above, this arrangement in phase opposition ensures that symmetrical currents are produced.

In the exemplary embodiment in FIG. 1, a lamp filament preheating means 4 is furthermore connected in series with the parallel circuit 3 and the second lamp filament 12. The lamp filament preheating means 4 comprises a reactance, which in the exemplary embodiment is in the form of a capacitor 41.

In the exemplary embodiment, a switch 5 is connected in parallel with the parallel circuit 3, which switch makes it possible to bridge the parallel circuit 3 and therefore the LEDs 31*a* to 31*c* and 32*a* to 32*c* when the fluorescent lamp 1 is ignited in order to reduce the damping in the resonant circuit or to shut down the LED light. In the exemplary embodiment, an additional reactance, which is in the form of a capacitor 6, is connected in parallel with this switch 5 and the parallel circuit 3. This means that it is possible for the current through the parallel circuit 3 to be set.

The invention claimed is:

1. A lighting system comprising:

an electric lamp, which has a first and at least one second lamp filament;

an electronic ballast, which is electrically connected to the lamp filaments; and at least two further light sources, which are connected in a parallel circuit with one another, wherein the parallel circuit comprising the two further light sources is connected in series between the first and the second lamp filament, and wherein a lamp filament preheating means is connected in series with the parallel circuit comprising the two further light sources.

2. The lighting system as claimed in claim 1, wherein the at least two further light sources are electrically connected to a first terminal of the first lamp filament and a first terminal of the second lamp filament.

3. The lighting system as claimed in claim 1, wherein the electronic ballast is electrically connected to a second terminal of the first lamp filament and to a second terminal of the second lamp filament.

4. The lighting system as claimed in claim 1, wherein the two further light sources are in the form of LEDs and are connected in phase opposition to one another into the respective signal paths of the parallel circuit.

5. The lighting system as claimed in claim 1, wherein the lamp filament preheating means is electrically connected to the first terminal of the second lamp filament.

6. The lighting system as claimed in claim 1, wherein the lamp filament preheating means has a reactance, in particular a capacitor.

7. The lighting system as claimed in claim 1, wherein a switch is connected in parallel with the parallel circuit comprising the further light sources.

8. The lighting system as claimed in claim 1, wherein a reactance is connected in parallel with the parallel circuit comprising the further light sources.

9. The lighting system as claimed in claim 8, wherein said reactance is a capacitor.

* * * * *